US008337273B2

(12) United States Patent
Han

(10) Patent No.: US 8,337,273 B2
(45) Date of Patent: Dec. 25, 2012

(54) OPERATION UNIT FOR TOY PARKING TOWER

(76) Inventor: Cheng-Hua Han, Taichung (TW)

( * ) Notice: Subject to any disclaimer, the term of this patent is extended or adjusted under 35 U.S.C. 154(b) by 486 days.

(21) Appl. No.: 12/659,674

(22) Filed: Mar. 17, 2010

(65) Prior Publication Data

US 2011/0230117 A1 Sep. 22, 2011

(51) Int. Cl.
*A63H 17/44* (2006.01)

(52) U.S. Cl. ..... 446/423; 446/489; 446/476; 446/424

(58) Field of Classification Search ..... 446/423, 446/476–478, 489, 448, 445, 444, 409, 435, 446/433, 227, 168–174, 75–78, 424, 486; 411/347; 24/613; 414/1, 592; *A63H 17/44*
See application file for complete search history.

(56) References Cited

U.S. PATENT DOCUMENTS

| | | | | | |
|---|---|---|---|---|---|
| 195,011 | A | * | 9/1877 | Ireland | 446/476 |
| 618,810 | A | * | 1/1899 | Wood | 446/476 |
| 806,930 | A | * | 12/1905 | Smith | 187/405 |
| 1,452,608 | A | * | 4/1923 | Kirst | 414/594 |
| 1,472,783 | A | * | 11/1923 | Bauer | 446/444 |
| 1,627,959 | A | * | 5/1927 | Disney | 414/262 |
| 1,770,018 | A | * | 7/1930 | Stillman | 446/489 |
| 2,262,933 | A | * | 11/1941 | Heinmiller | 476/26 |
| 3,281,985 | A | * | 11/1966 | Einfalt | 446/423 |
| 3,286,971 | A | * | 11/1966 | Walter et al. | 248/429 |
| 3,483,653 | A | * | 12/1969 | Robert | 446/423 |
| 3,593,454 | A | * | 7/1971 | Einfalt | 446/423 |
| 3,694,953 | A | * | 10/1972 | Tomiyama | 446/423 |
| 3,789,538 | A | * | 2/1974 | Spengler et al. | 446/409 |
| 3,849,930 | A | * | 11/1974 | Stubbmann | 446/137 |
| 4,109,410 | A | * | 8/1978 | Saitoh | 446/178 |
| 4,291,488 | A | * | 9/1981 | Orenstein | 446/314 |
| 4,359,837 | A | * | 11/1982 | Hool | 446/171 |
| 5,209,018 | A | * | 5/1993 | Heinrich | 49/449 |
| D366,290 | S | * | 1/1996 | Dieudonne | D21/509 |
| 6,074,328 | A | * | 6/2000 | Johnson | 482/97 |
| 7,762,931 | B2 | * | 7/2010 | Fisher et al. | 482/57 |
| 8,162,716 | B2 | * | 4/2012 | Nuttall | 446/444 |

* cited by examiner

*Primary Examiner* — Gene Kim
*Assistant Examiner* — Matthew B Stanczak

(57) ABSTRACT

A toy parking set includes multiple floors and a tower is connected to the toy parking set. The tower includes an opening which is located corresponding each of the floors. A slot is defined through a wall of the tower. A box is received in the tower and a frame is fixed on the top of the box. A shaft extends through the frame and the slot of the tower. A spring is biased between the flange of the shaft and the inside of the end of the frame. The shaft extends through the box and the slot and is connected to an end member. The end member includes an engaging portion which is removably engaged with the slot. The players pull shaft to remove the engaging portion from the slot to move the box to desired floor.

4 Claims, 6 Drawing Sheets

OPERATION UNIT FOR TOY PARKING TOWER

BACKGROUND OF THE INVENTION (1) Field of the Invention

The present invention relates to a toy parking tower, and more particularly, to an operation unit for a toy parking tower.

(2) Description of the Prior Art

A conventional toy parking set is too simple to attract children to play for a long period of time and the convention toy parking set simply is a plate enclosed by a fence which includes an entrance and an exit, the players move the toy cars into the paring set via the entrance and leave the parking set from the exit. The simple way is so boring and cannot attract the children. FIG. 1 shows another conventional toy parking set 10 which includes at least two floors 11, 12, 13 and a parking tower 20 is connected to the parking set 10. The parking tower 20 includes a box 21 which can be moved up and down in the parking tower 20.

The box 21 includes a rotation unit 25 located at the top thereof and a shaft 26 is connected between two opposite walls of the parking tower 20. An operation wheel 27 is connected to outside of the parking tower 20 and a rope has one end wrapped around the shaft 26 and the other end of the rope is fixed to the box 21. The players rotate the operation wheel 27 to lift the box 21 form the lower floor 11 to a higher floor 12 or 13 so as to deliver the car in the box 21 to the desired floor. When the car needs to be lower from the higher floor to the lower floor, the operation wheel 27 is released and the gravity will lower the box together with the car in the box 21 to the lower floor.

However, the weight of the box and the car in the box may not be sufficient to descend and there is no proper guide system to smoothly guide the box to descend.

The present invention intends to provide an operation unit for a toy parking tower which provides the players more fun during multiple operation steps.

SUMMARY OF THE INVENTION

The present invention relates to a toy parking set which comprises at least two floors and a tower is connected to the toy parking set and includes an opening which is located corresponding each of the at least two floors. The tower includes two opposite walls other than the wall having the opening, one of the two opposite walls has a slot defined therethrough. A box is movably received in the tower and an operation unit is connected on a top of the box. The operation unit includes a frame within which a space is defined. The frame is fixed on the top of the box and has a hole defined through an end thereof. A shaft is located in the space and a spring is mounted to the shaft. The shaft includes a flange at a first end thereof and the spring is biased between the flange and an inside of the end of the frame. A second end of the shaft extends through the hole of the box and the slot of the tower and is connected to an end member.

The primary object of the present invention is to provide a toy parking set which allows the players to directly move the box along the tower so as to precisely set the box at the corresponding floor. The car in the box is moved onto the floor. The precision of the movement of the box increases the attraction to the players and enhances the value of the toy parking set.

Another object of the present invention is to provide a toy parking set wherein the box is guided by the guide groove in the tower and the ridge of the box such that the movement of the box is smooth and easy.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
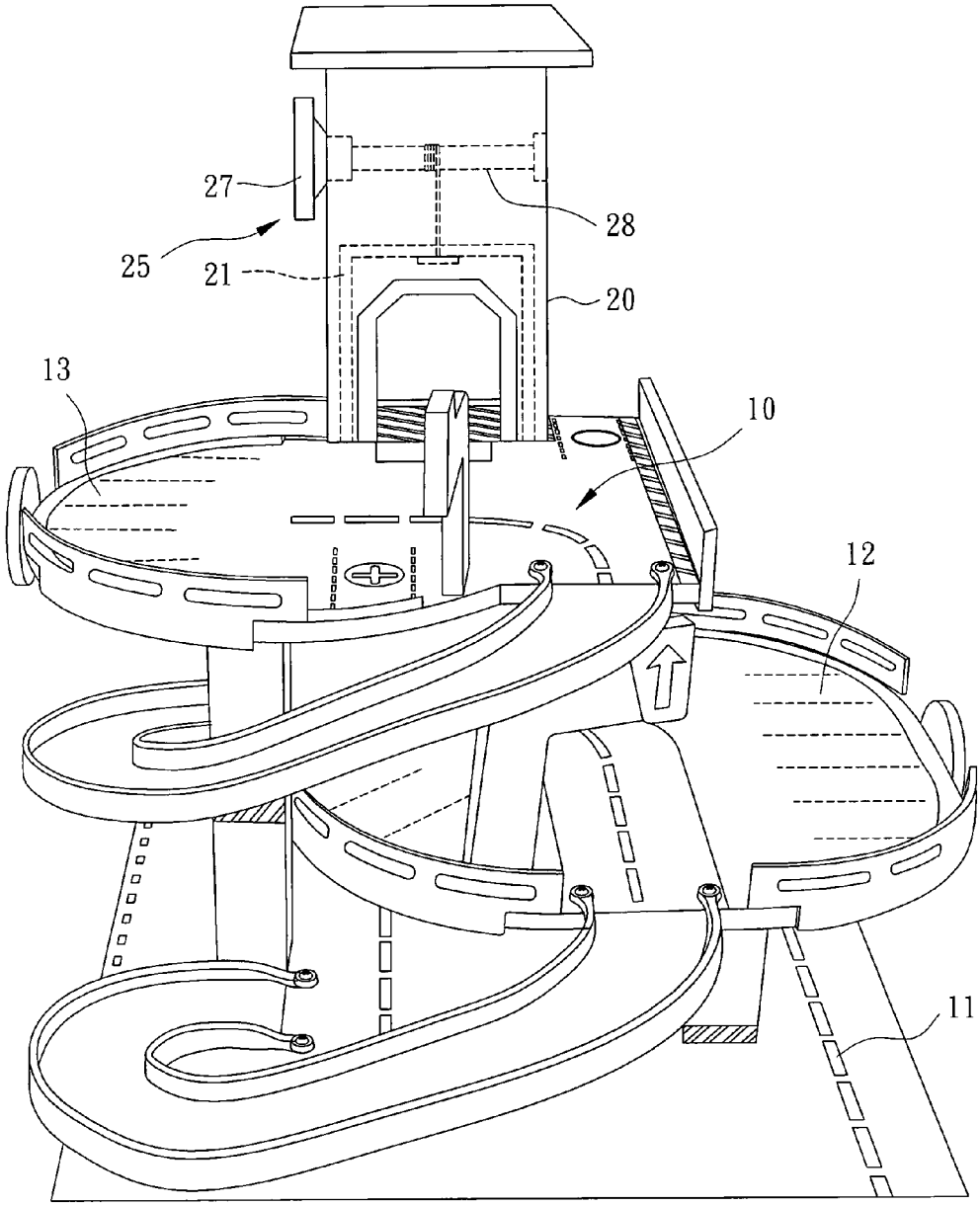
FIG. 1 Prior Art
FIG. 1 shows a conventional toy parking set.
Figure 2:
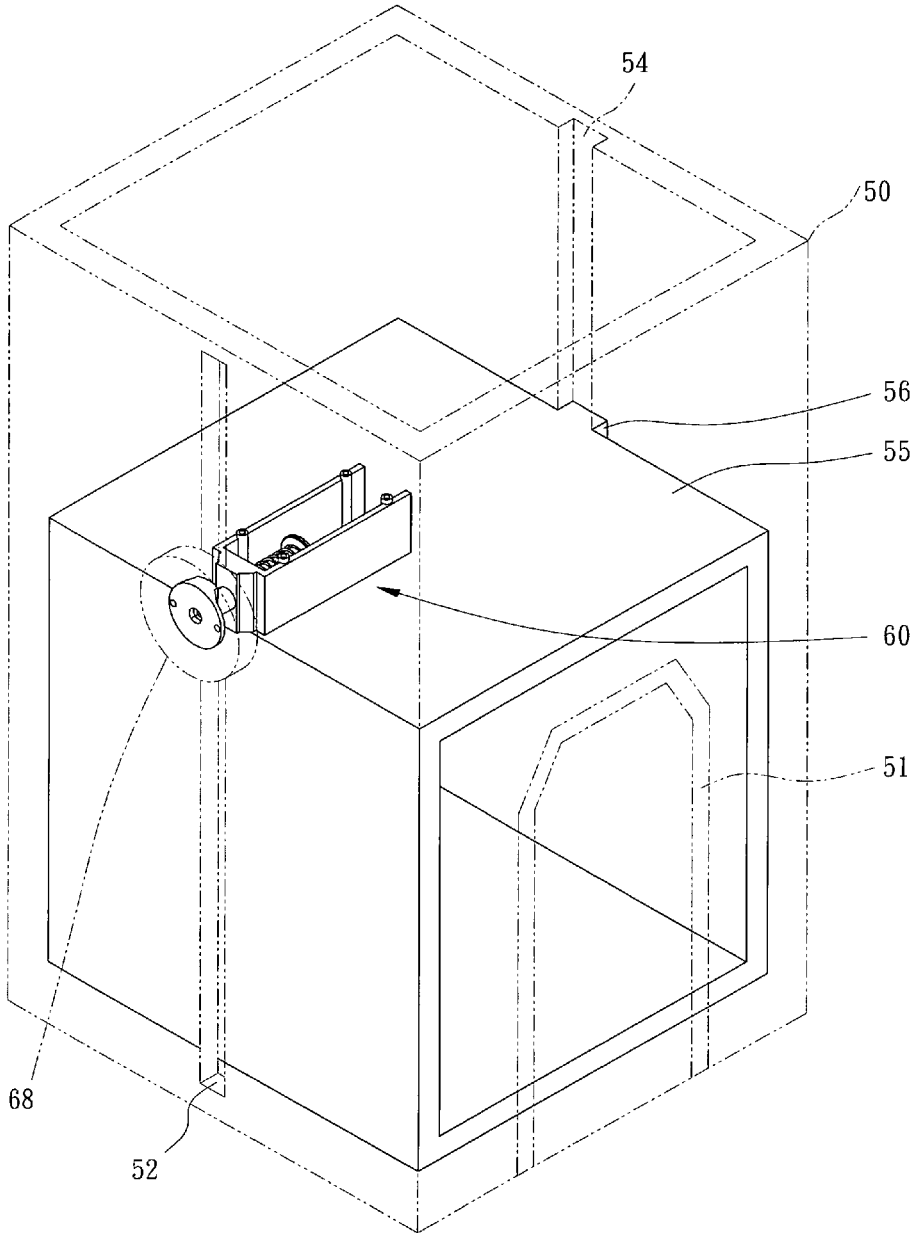
FIG. 2 shows the operation unit of the toy parking set of the present invention.
Figure 3:
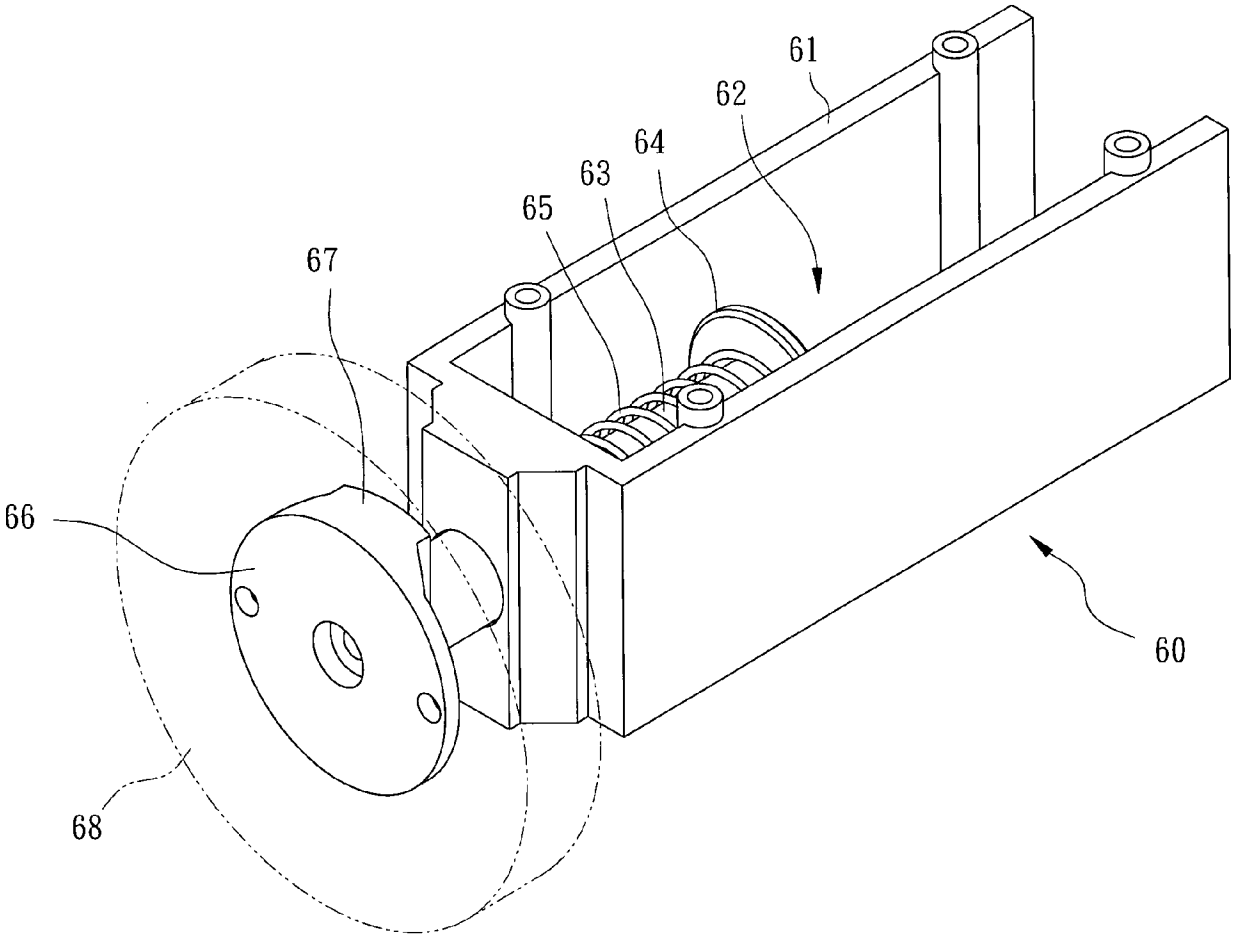
FIG. 3 is a perspective view to show the operation unit of the toy parking set of the present invention.
Figure 4:
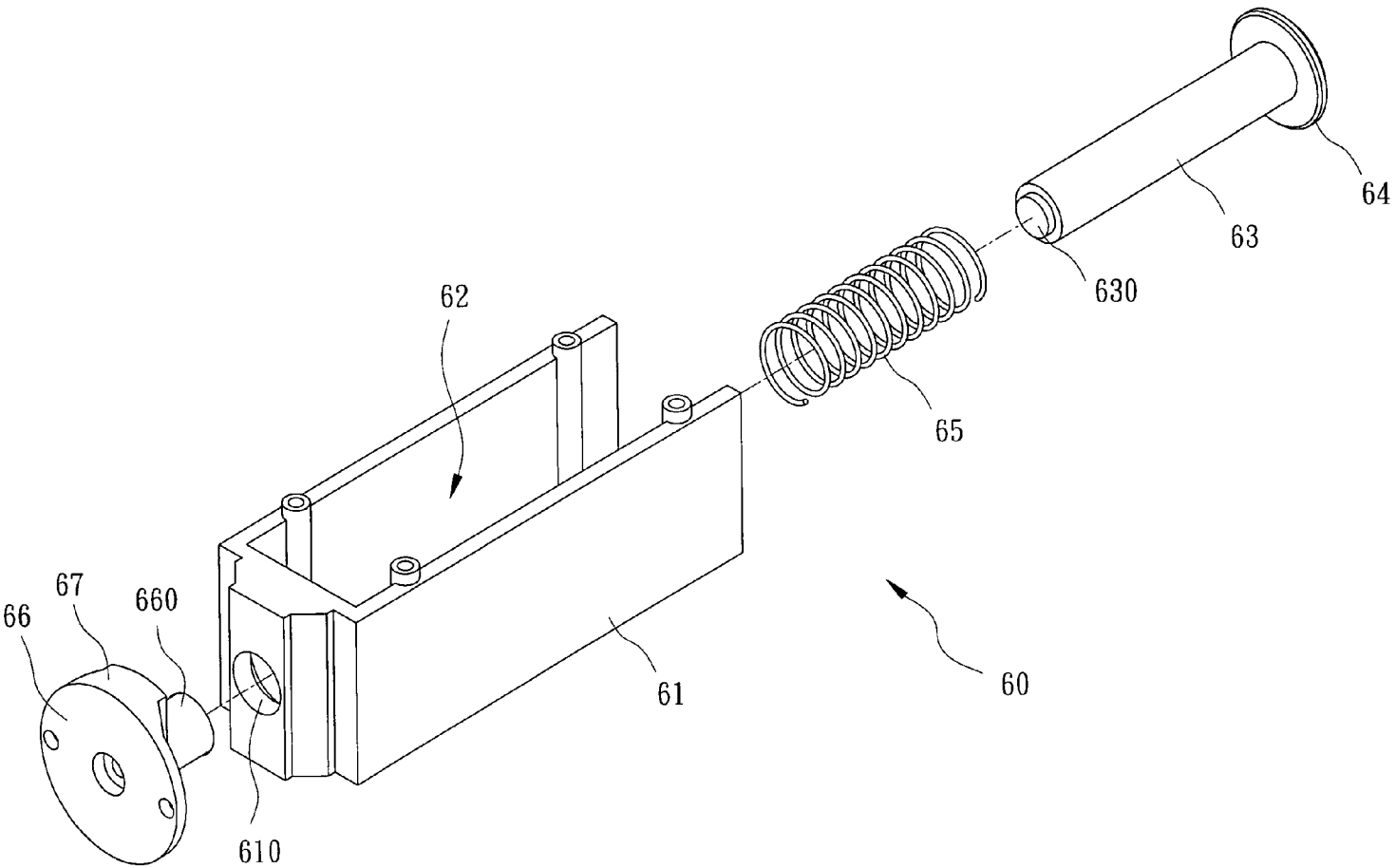
FIG. 4 is an exploded view to show the operation unit of the toy parking set of the present invention.
Figure 5:
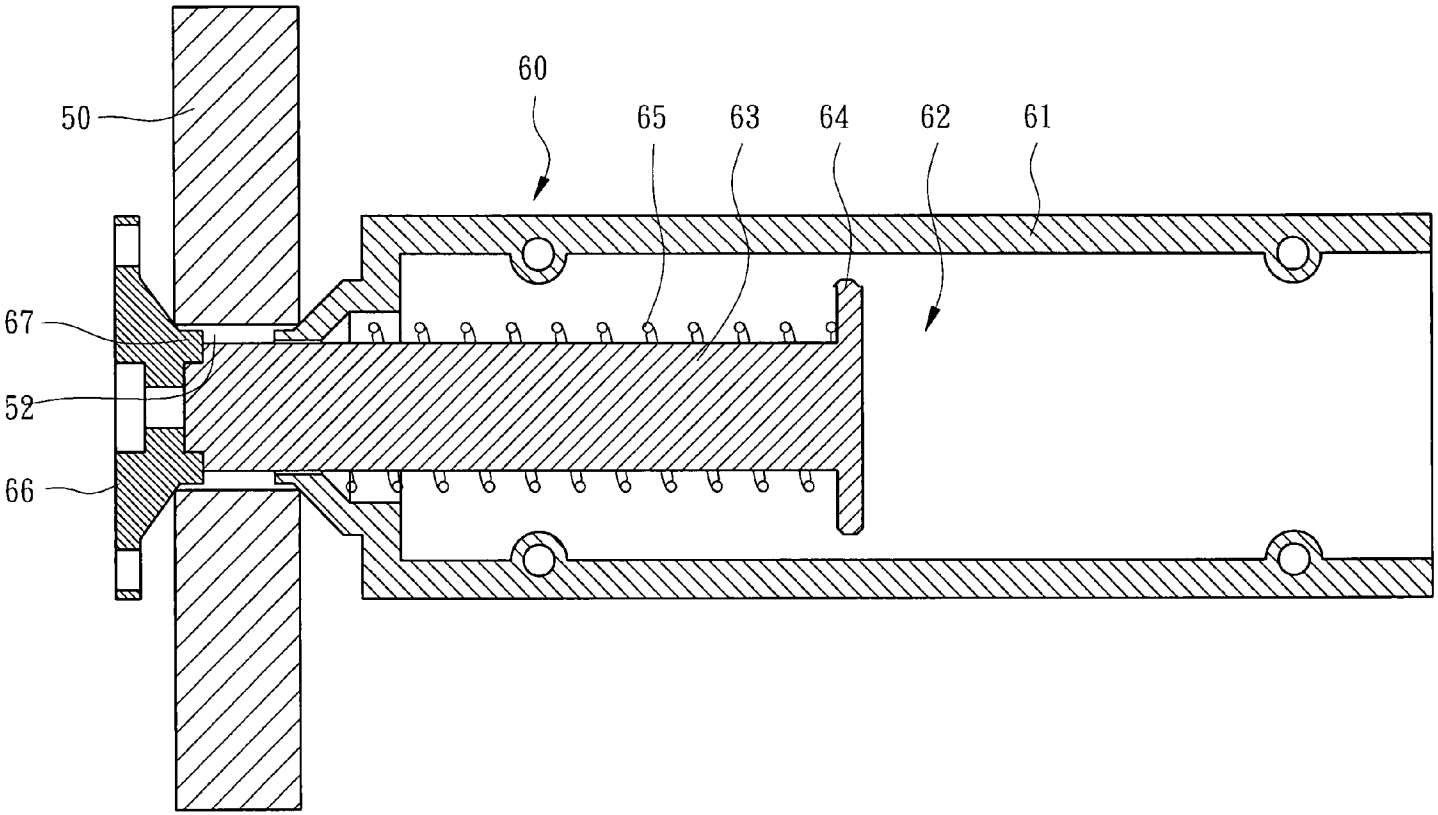
FIG. 5 is a cross sectional view to show that the engaging portion of the end member is engaged with the slot of the box.

Referring to FIGS. 2 to 5, the toy parking set 10 of the present invention comprises at least two floors, in this embodiment, there are three floors 11, 12, 13. A tower 50 is connected to the toy parking set 10 and includes an opening 51 defined through a wall thereof. The opening 51 is located corresponding each of the floors 11, 12, 13 so that the cars can be moved between the floors and the tower 50 via the opening 51. The tower 50 includes two opposite walls other than the wall having the opening 51, one of the two opposite walls has a slot defined therethrough and a guide groove 54 is defined in the other one of the two opposite walls.

A box 55 is movably received in the tower 50 and an operation unit 60 is connected on a top of the box 55. The operation unit 60 includes a frame 61 within which a space 62 is defined. The frame 61 is fixed on the top of the box 55 and has a hole defined through an end thereof. A shaft 63 is located in the space 62 and a spring 65 is mounted to the shaft 63. The shaft 63 includes a flange 64 at a first end thereof and the spring 65 is biased between the flange 64 and an inside of the end of the frame 61. A second end of the shaft 63 includes a connection end 630 which extends through the hole 610 of the box 55 and the slot 52 of the tower 50 and is connected to a connection portion 660 of an end member 66. The end member 66 includes an engaging portion 67 which is shaped and sized to be removably engaged with the slot 52 of the tower 50. The box 55 further includes a ridge 56 which is movably engaged with the guide groove 54. An operation member 68 is connected to the end member 66 which is accessed from outside of the tower 50.

When the players do not pull the operation member 68 away from the tower 50, the force of the spring 65 clamps the wall of the tower 5*o* between the wall of the box 55 and the operation member 68, so that the box 50 can be set at a desired position.

Figure 6:
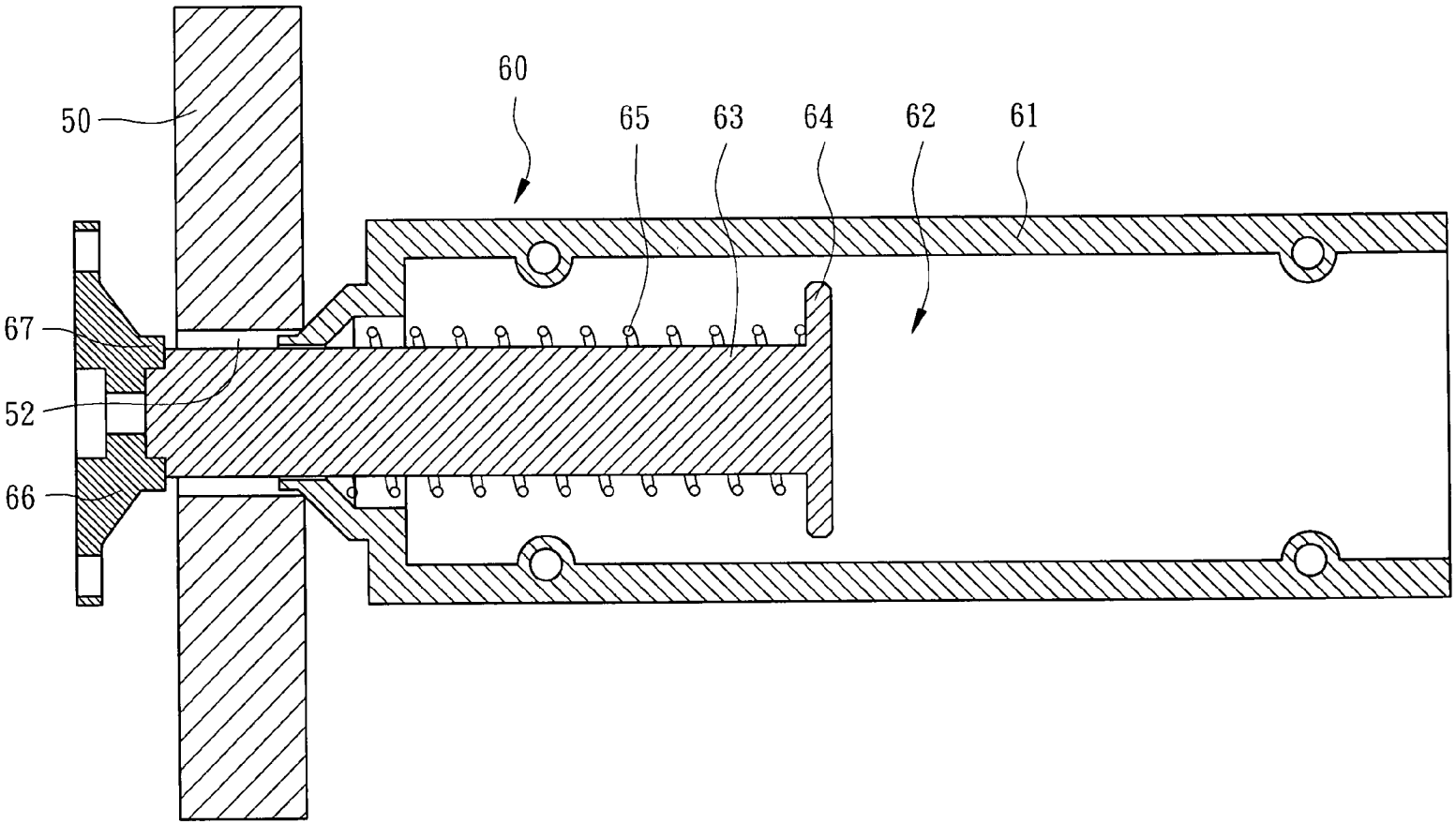
FIG. 6 is a cross sectional view to show that the end member is pulled and the engaging portion of the end member is disengaged from the slot of the box.

As shown in FIG. 6, when the players pull the operation member 68 away from the tower 50, the engaging portion 67 is disengaged from the slot 52 and the players can directly move the box 50 to a desired floor 11/12/13. The car in the box

55 can be then moved from the box 50 to the floor 11/12/13 via the opening 51. Alternatively, the car on the floor 11/12/13 can be moved into the box 55 via the opening 51. The players can move the box 55 smoothly by the guidance of the ridge 56 and the guide groove 54. When releasing the operation member 68, the spring pushes the shaft 63 and the engaging portion 67 is engaged with the slot 52 again to set the box 55.

While we have shown and described the embodiment in accordance with the present invention, it should be clear to those skilled in the art that further embodiments may be made without departing from the scope of the present invention.

What is claimed is:

1. A toy parking set comprising:

at least two floors;

a tower connected to the toy parking set and including an opening defined through a wall thereof and the opening being located corresponding each of the at least two floors, the tower including two opposite walls other than the wall having the opening, one of the two opposite walls having a slot defined therethrough;

a box movably received in the tower and an operation unit connected on a top of the box, the operation unit including a frame within which a space is defined, the frame fixed on the top of the box and having a hole defined through an end thereof, and a shaft located in the space and a spring mounted to the shaft, the shaft including a flange at a first end thereof and the spring being biased between the flange and an inside of the end of the frame, a second end of the shaft extending through the hole of the box and the slot of the tower and being connected to an end member.

2. The toy parking set as claimed in claim 1, wherein the end member includes an engaging portion which is removably engaged with the slot of the tower.

3. The toy parking set as claimed in claim 1, wherein a guide groove is defined in the other one of the two opposite walls and the box includes a ridge which is movably engaged with the guide groove.

4. The toy parking set as claimed in claim 1, wherein an operation member is connected to the end member which is accessed from outside of the tower.

* * * * *